United States Patent [19]

Mur Gimeno et al.

[11] Patent Number: 4,905,834

[45] Date of Patent: Mar. 6, 1990

[54] STACKABLE CONTAINER

[75] Inventors: Emilio Mur Gimeno, Alicante; Francisco Iborra Guijarro, San Vicente del Raspeig, both of Spain

[73] Assignee: Iberoamericana Del Embalaje, S.A., Spain

[21] Appl. No.: 358,953

[22] Filed: May 30, 1989

[30] Foreign Application Priority Data

May 30, 1988 [ES] Spain ..... 8801748
Jun. 13, 1988 [ES] Spain ..... 8801893
Jun. 17, 1988 [ES] Spain ..... 8801956

[51] Int. Cl.[4] ..... B65D 5/20

[52] U.S. Cl. ..... 206/512; 229/916; 229/918; 229/919; 206/557

[58] Field of Search ..... 206/503, 509, 512, 557; 229/916, 918, 919

[56] References Cited

U.S. PATENT DOCUMENTS 4,151,948 5/1979 Fuente, Jr. ..... 206/512
4,537,344 8/1985 Thomas ..... 229/919 X
4,792,084 12/1988 Dreeszeh ..... 229/919 X

FOREIGN PATENT DOCUMENTS 3530350 8/1986 Fed. Rep. of Germany ..... 229/919
2447862 8/1980 France ..... 229/918
2456670 12/1980 France ..... 229/919

*Primary Examiner*—William Price
*Attorney, Agent, or Firm*—Ostrolenk, Faber, Gerb & Soffen

[57] ABSTRACT

An economic stackable container of foldable corrugated material with improved strength for forming a stable stack of containers. Ventilation spaces are provided between stacked containers. The arrangement of panel is disclosed. An extension formed at the top at each corner projects into a notch formed at the bottom of a respective corner of the container above. The panels are particularly reinforced by folded panels at the corners. A separate reinforcing sheet is applied around the periphery of the panels of the main sheet. The sheets have their corrugations in the various panels oriented for strength.

26 Claims, 2 Drawing Sheets

FIG.1
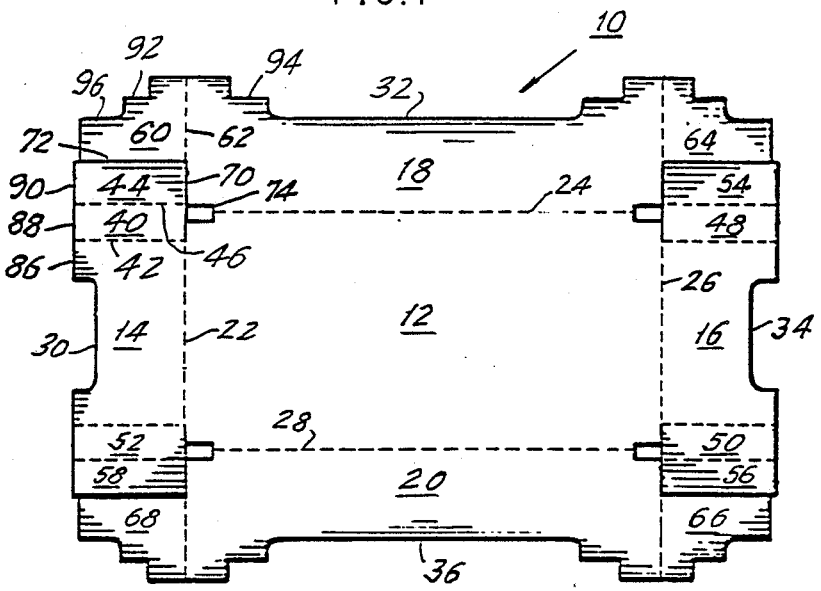
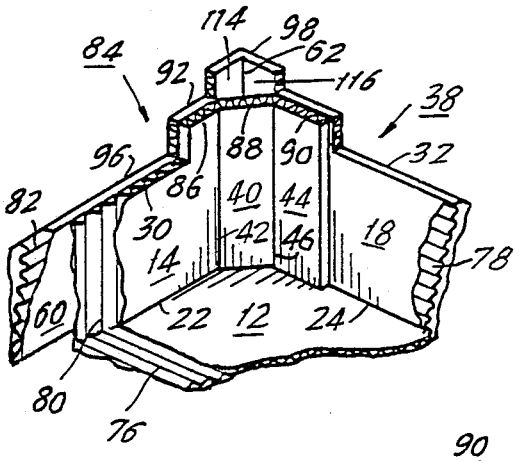
FIG.2
FIG.3
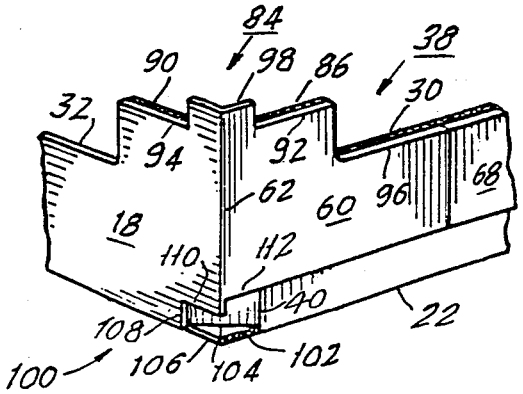

STACKABLE CONTAINER

BACKGROUND OF THE INVENTION

The invention relates to a stackable container and a blank for forming such a stackable container.

Stackable containers or boxes (also referred to as "trays" or "dishes") for containing, packaging, and/or transporting perishable products are known. These containers are stacked one on top of the other and therefore must be able to withstand significant compression, depending on the weight of material in the containers and the height of the stack. That is, a container at the bottom of a stack must withstand all of the weight of the containers stacked above it. Such stress tends to deform or even break the lower container which may cause an entire stack to become unbalanced and topple over.

This a particular problem for relatively large containers formed of corrugated cardboard (or equivalent material) with horizontally corrugated sides. Such sides can be easily deformed or broken by the weight of a stack.

It is also important to properly position stackable containers directly on top of each other to create a balanced, stable stack.

A stackable tray has been created by IBEROAMERICANO DEL EMBALAJE, S.A., deposited in Spain under No. 284,792. This tray has double walls in two of its opposite sides and a support and slotting mechanism at its corners.

However, prior art stackable containers have been either (1) inadequately reinforced and therefore relatively unsafe and unstable or (2) adequately reinforced, but complicated, requiring an uneconomic amount of material, and/or being expensive to manufacture.

SUMMARY OF THE INVENTION

Accordingly, it is an object of the invention to provide a stackable container with reinforced walls (particularly, reinforced corners), which is strong, which forms a stable stack, which requires a minimum of material, and which can be inexpensively assembled, completely by machine.

Thus, the invention is directed to a stackable container formed of foldable corrugated material. The container includes a bottom panel for being supported on a lower container and for forming a bottom of the stackable container. There is an end panel for forming an end of the stackable container. The end panel is connected to the bottom panel by a fold line. The end panel has vertical corrugations. There is a support panel for supporting an upper container on the stackable container. The support panel is connected to the end panel by a fold line. The support panel has vertical corrugations A side panel forms a side of the stackable container. The side panel is connected to the bottom panel by a fold line. The side panel has horizontal corrugations. A reinforcing flap reinforces the end panel The reinforcing flap is connected to the side panel by a fold line The reinforcing flap is connected to the end panel along a substantial portion of the end panel. The reinforcing flap has horizontal corrugations. The container also includes an extension above the support panel for positioning the upper container on the stackable container. It includes an opening beneath the extension for receiving an extension of the lower container to position the stackable container on the lower container.

The invention is also directed to a blank for forming such a container.

The invention is also directed to a stackable container formed of foldable material. The container includes a main sheet and a reinforcing sheet. The main sheet includes: a bottom panel for being supported on a lower container and for forming a bottom of the stackable container; a side panel for forming a side of the stackable container, the side panel being connected to the bottom panel by a fold line; a support panel for supporting an upper container on the stackable container, the support panel being connected to the side panel by a fold line; and a connection panel connected to the bottom panel by a fold line. The reinforcing sheet is formed separately from the main sheet. The reinforcing sheet includes: an end panel for forming an end of the stackable container, the end panel connected to the connection panel; and a reinforcing flap connected to the end panel by a fold line. The reinforcing flap is connected to the side panel along a substantial portion of the side panel. The container also includes an extension above the support panel for positioning the upper container on the stackable container. The container includes an opening beneath the extension for receiving an extension of the lower container to position the stackable container on the lower container.

The invention is also directed to a blank for forming such a container.

Other features and objects of the invention will become apparent from the following detailed description of preferred embodiments of the invention considered in conjunction with the accompanying drawings.

BRIEF DESCRIPTION OF THE DRAWINGS

FIG. 1 is a plan view of a container blank in accordance with a preferred embodiment of the invention;

FIG. 2 is a perspective view of the inside of a corner of a container formed from the blank of FIG. 1;

FIG. 3 is a perspective view of the outside of the corner of FIG. 2;

DETAILED DESCRIPTION OF THE PREFERRED EMBODIMENTS

Figure 4:
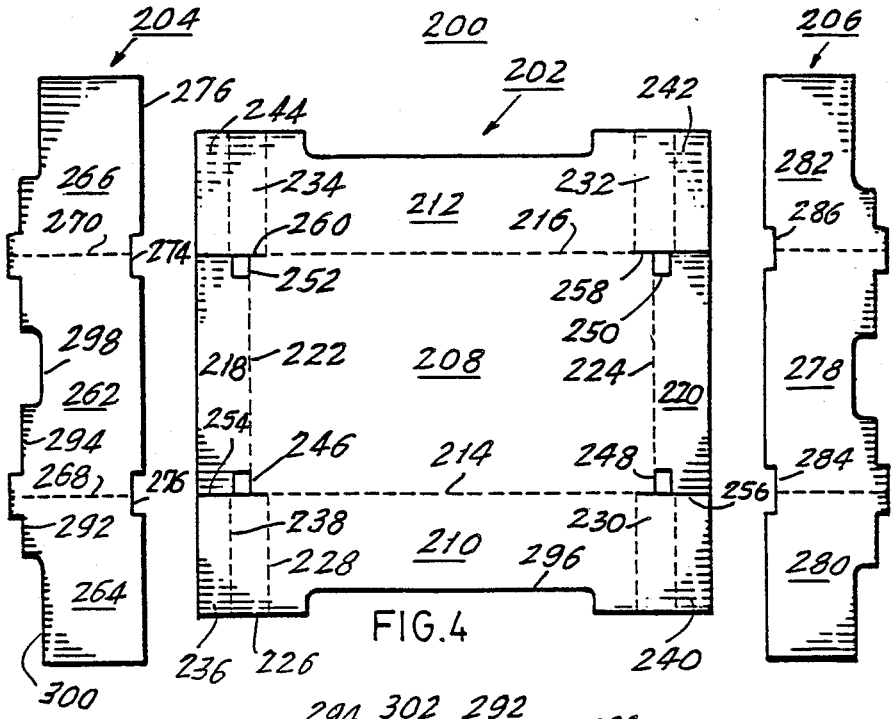
FIG. 4 is a plan view of a blank in accordance with another preferred embodiment of the invention.

Referring to FIG. 1, a blank 10 in accordance with a first preferred embodiment of the invention includes a bottom panel 12, end panels 14 and 16, and side panels 18 and 20. The bottom panel 12 is connected to the end panels 14 and 16 and to the side panels 18 and 20 by fold lines 22–28. The end panels 14 and 16 and the side panels 18 and 20 have edges 30–36 which define the upper edges of the ends and sides of a stackable container 38 (FIG. 2).

A support panel 40 at one corner of bottom panel 12 is connected to the end panel 14 by a fold line 42. A respective end flap 44 is connected to the support panel 40 by a fold line 46. Similarly, support panels 48–52 (FIG. 1) at each of the three other corners of the bottom panel 12 are connected to the end panels 14 and 16 by fold lines (not numbered) and respective end flaps 54–58 are connected to the support panels 48–52 by fold lines (not numbered).

A reinforcing flap 60 at one corner is connected to the side panel 18 by a fold line 62. Similarly, reinforcing flaps 64–68 are connected at each of the three other corners of the blank 10 to the side panels 18 and 20 by fold lines (not numbered).

The blank 10 is punched or cut out of a single sheet of corrugated cardboard (or equivalent material). Thus, a cut 70 separates the end flap 44 and the support panel 40 from the side panel 18 and the bottom panel 12. Three other similar cuts (not numbered) separate the respective end flaps 54–58 and the support panels 48–52 from the side panels 18 and 20 and the bottom panel 12. A cut 72 separates the end flap 44 from the reinforcing flap 60 and three other similar cuts (not numbered) separate the respective end flaps 54–58 from the reinforcing flaps 64–68.

A notch 74 is cut out of one corner of the bottom panel 12 and the corresponding corner of side panel 18. Three other similar notches (not numbered) are cut out of the respective corners of the side panels 18 and 20 and the bottom panel 12.

The stackable container 38 is formed by folding the end panel 14 upwardly and inwardly around the fold line 22 such that the upstanding end panel 14 and the bottom panel 12 form a 90° angle around the horizontal fold line 22. The support panel 40 is folded inwardly around the vertical fold line 42 such that the support panel 40 forms a vertical 45° angle with the end panel 14. The end flap 44 is folded inwardly around the vertical fold line 46 such that the end flap 44 forms a vertical 45° angle with the support panel 40.

The side panel 18 is folded upwardly and inwardly around the fold line 24 such that the side panel 18 forms a 90° angle with the bottom panel 12. The entire outside surface of the end flap 44 is adhesively secured to an inside surface of the side panel 18. The reinforcing flap 60 is folded inwardly around the fold line 62 such that the reinforcing flap 60 forms a vertical 90° angle with the side panel 18. The inside surface of the reinforcing flap 60 is adhesively secured to the entire corresponding portion of the outside surface of the end panel 14.

Only a single corner of the container 38 can be seen in FIG. 2. However, the end flaps 54–58, the support panels 48–52, and the reinforcing flaps 64–68 form three other corners which are similar to the corner illustrated in FIG. 2. Thus, the container 38 has four symmetrical corners.

Conventionally, the corrugated cardboard (or equivalent material) includes an inner layer of corrugated paper sandwiched between relatively flat outer layers of paper as illustrated by broken away portions of FIG. 2. Corrugations throughout the blank 10 are parallel to each other with the corrugations 76 (FIG. 2) of the bottom panel 12 being parallel to the fold line 24 between the side panel 18 and the bottom panel 12. Therefore, the corrugations 78 of the side panel 18 are horizontal within the container 38. The corrugations 80 of the end panel 14 are vertical, as are the corrugations (not numbered) of the support panel 40 and the corrugations (not numbered) of the end flap 44. The corrugations 82 of the reinforcing flap 60 are horizontal—perpendicular to the corrugations 80 of the end panel 14.

The crossed orientation of the corrugations with respect to each other imparts strength and stability to the container 38. Since the corrugations of the support panel 40 are vertical, the bottom of an upper container (not illustrated) stacked on top of the container 38 can rest on the support panel 40 without crushing the support panel 40. The support panel 40 is further strengthened by the vertical corrugations 80 of the end panel 14 and the vertical corrugations of the end flap 44. Lateral strength for the sides of the container 38 is provided by the horizontal corrugations 78 of the side panel 18. The side panel 18 is further reinforced by the end flap 44. The reinforcing flaps 60 and 64–68 together with the end panels 14 and 16 form resistant double end walls with perpendicular corrugations. In sum, the resistance of the container 38 to both horizontal and vertical forces is maximized with a minimum of material.

In the embodiment illustrated in FIGS. 1–3, the end panels 14 and 16 are shorter than the side panels 18 and 20. However, the side panels 18 and 20 can be shorter than the end panels 14 and 16. In any event, the reinforcing flaps 60 and 64–68 cover a substantial portion, preferably approximately, or at least approximately 70% of, up to even all of, the outside surface of the end panels 14 and 16.

The container 38 includes a support structure 84 for supporting and aligning the upper container with respect to the stackable container 38. The support structure 84 includes a raised edge 86 of the end panel 14, and top edges 88 and 90 of the support panel 40 and the end flap 44. The edges 86–90 extend in step-wise fashion above the edges 30 and 32 of the end panel 14 and the side panel 18.

The reinforcing flap 60 also includes a raised edge 92 which, in step-wise fashion, is at the same height as the edge 86. Similarly, the side panel 18 has a raised edge 94 which is at the same height as the edge 90 of the end flap 44.

The particular arrangement of the edges 86–94 with respect to the edges 30 and 32 of the end panel 14 and the side panel 18 and with respect to an elongate edge 96 of the reinforcing flap 60 provides an important advantage. That is, when the upper container is placed on the edge 88 of the support panel 40, ventilation spaces are provided not only between the edges 32 and 36 of the side panels 18 and 20 and the upper container, but also between the edges 30 and 34 of the end panels 14 and 16 and the upper container, and between the elongated edges of the reinforcing flaps 60 and 64–68 and the upper container. This permits proper ventilation of the perishable contents of the stacked containers.

The support structure 84 includes an angular extension 98 which extends upwardly in stepwise fashion from the raised edge 92 of the reinforcing flap 60 and the raised edge 94 of the side panel 18. The extension 98 extends above the edge 88 of the support panel 40.

An opening 100 (FIG. 3) beneath the support structure 84 includes edges 102 and 104 defined by the cut 70 (FIG. 1), edges 106–110 defined by the notch 74, and an edge 112 defined by the cut 72.

In use, identical stackable containers 38 are stacked on top of each other with an angular extension 98 of each corner of a supporting container fitting within an opening 100 of each corner of a container supported on the supporting container. The angular extension 98 fits within the opening 100 of the supported container with inside surfaces 114 and 116 of the extension 98 adjacent the edges 102 and 106 of the opening 100.

The cooperation between the angular extensions 98 of a lower container and the openings 100 of an upper container prevent the upper container from shifting sideways with respect to the lower container, creating a balanced, stable stack.

Referring to FIG. 4, a blank 200 in accordance with a second preferred embodiment of the invention includes a main sheet 202 and separately formed reinforcing sheets 204 and 206. The main sheet 202 includes a bottom panel 208 and side panels 210 and 212 connected to the bottom panel 208 by fold lines 214 and 216. Opposite connection panels 218 and 220 are connected to the bottom panel 208 by fold lines 222 and 224. A support panel 226 at one corner is connected to the side panel 210 by a fold line 228. Similarly, three support panels 230–234 are connected to the side panels 210 and 212 at the three other corners by fold lines (not numbered). An end flap 236 at one corner is connected to the support panel 226 by a fold line 238 and similar end flaps 240–244 are connected to the support panels 230–234 at the three other corners by fold lines (not numbered). Notches 246–252 are cut out of the connection panels 218 and 220.

Like the blank 10, the main sheet 202 is cut or punched out of a single sheet of foldable corrugated cardboard or an equivalent material. Thus, a cut 254 at one corner separates the support panel 226 and the end flap 236 from the bottom panel 208 and the connection panel 218. Similar cuts 256–260 at the three other corners separate the support panels 226 and 230–234 and the end flaps 236 and 240–244 from the connection panels 218 and 220 and the bottom panel 208.

The reinforcing sheet 204 is also formed from a single sheet of foldable corrugated cardboard. But in this embodiment, the reinforcing sheet 204 is separate from the main sheet 202. The reinforcing sheet 204 includes an end panel 262 and reinforcing flaps 264 and 266 connected to opposite edges of the end panel 262 by fold lines 268 and 270. Cut out portions 272 and 274 are cut out of a bottom edge 276 of the reinforcing sheet 204 in the vicinity of the fold lines 268 and 270.

The reinforcing sheet 206 is identical but symmetric to the opposite reinforcing sheet 204. The reinforcing sheet 206 includes an end panel 278, with reinforcing flaps 280 and 282 connected to opposite edges of the end panel 278 by fold lines (not numbered), and with cut out portions 284 and 286 cut out of the reinforcing sheet 206 in the vicinity of the fold lines.

The blank 200 is formed into a stackable container 288 by folding the side panel 210 inwardly and upwardly around the fold line 214 such that the side panel 210 and the bottom panel 208 form a 90° angle. The support panel 226 is folded inwardly around the fold line 228 such that the support panel 226 forms a 45° angle with the side panel 210. The end flap 236 is folded inwardly around the fold line 238 such that the end flap 236 and the support panel 226 form a 45° angle and such that the end flap 236 is parallel to the fold line 222 between the connection panel 218 and the bottom panel 208.

The reinforcing sheet 204 is then connected to the main sheet 202 by adhesively securing the entire outside surface of the end flap 236 to the end panel 262, folding the reinforcing flap 264 inwardly around the fold line 268 such that the reinforcing flap 264 and the end panel 262 form a 90° angle, and adhesively securing the inside surface of the reinforcing flap 264 to the entire corresponding portion of the outside surface of the side panel 210. The connection panel 218 is then folded inwardly around the fold line 222 such that the connection panel 218 and the bottom panel 208 form a 90° angle and the entire inside surface of the connection panel 218 is adhesively secured to the outside surface of the end panel 262 to hold the end panel 262 in place.

The blank 200 is similarly folded around its other fold lines, the end flaps 240–244 are adhesively secured to the inside surfaces of the end panels 262 and 278 and the inside surfaces of the reinforcing flaps 280, 282, and 266 are adhesively secured to the outside surfaces of the side panels 210 and 212 to form a symmetrical four cornered structure.

Figure 5:
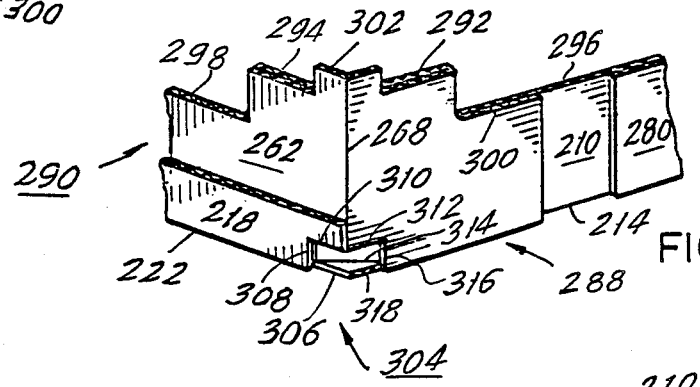
FIG. 5 is a perspective view of the outside of a corner of a container formed from the blank of FIG. 4.

As illustrated in FIG. 5, the container 288 includes a support structure 290 which, like the support structure 84 of the container 38, has raised edges 292 and 294 which, in step wise fashion, are elevated above the elongated edges 296–300 of the side panel 210, end panel 262, and reinforcing flap 264, for improved ventilation. An angular extension 302 extends upwardly from the reinforcing flap 264 and the end panel 262. As in the previously described embodiment, the extension 302 is designed to fit within an opening 304 of an identical stackable container supported on top of the stackable container 288.

The opening 304 is defined by edges 306–318. The edge 306 is defined by the notch 246. The edges 308 and 310 are defined by the notch 246 and the cut out portion 272. The edge 312 is defined by the cut out portion 272. The edges 314 and 318 are defined by the cut 254. The edge 316 is defined by the cut out portion 272.

In the embodiment illustrated in FIG. 5, the side panels 210 and 212 are longer than the connection panels 218 and 220 and the end panels 262 and 278. For strength and stability, corrugations of the reinforcing sheets 204 and 206 are vertical. Corrugations within the side panels 210 and 212 are horizontal, perpendicular to the corrugations of the reinforcing sheets 204 and 206, and corrugations within the connection panels 218 and 220 are vertical. The reinforcing flaps 264, 280, 282, and 266 cover a substantial portion, preferably approximately 70% or more, of the outside surface of the side panels 210 and 212.

Figure 6:
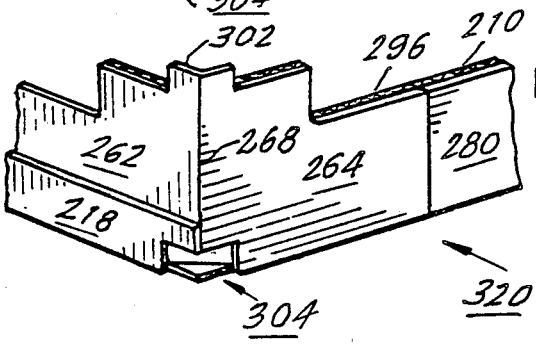
FIG. 6 is similar to FIG. 5, but in accordance with still another preferred embodiment of the present invention.

In the embodiment illustrated in FIG. 6, the side panels 210 and 212 are shorter than the connection panels 218 and 220 and the end panels 262 and 278. Corrugations within the reinforcing sheets 204 and 206 in this embodiment are horizontal, and for stability the reinforcing flaps 264, 280, 282, and 266 cover a substantial portion, preferably approximately 70% or more, and most preferably the entire outside surface of the side panels 210 and 212.

Although the present invention has been described in connection with preferred embodiments thereof, many variations and modifications may become apparent to those skilled in the art. It is preferred, therefore, that the present invention be limited not by the specific disclosure herein, but only by the appended claims.

What is claimed is:

1. A stackable container formed of foldable corrugated material, comprising:

a bottom panel forming a bottom of said stackable container; a first end panel for forming a first end of said stackable container, said end panel being connected to said bottom panel by a fold line, said end panel having vertical corrugations; a first support panel for supporting an upper container on said stackable container, said support panel being connected to said end panel by a fold line, said support panel having vertical corrugations; a first side panel for forming a first side of said stackable container, said side panel being connected to said bottom panel by a fold line, said side panel having horizontal corrugations; and a first reinforcing flap for reinforcing said end panel, said reinforcing flap being connected to said side panel by a fold line, said reinforcing flap being connected to said end panel along a substantial portion of said end panel, said reinforcing flap having horizontal corrugations;

an extension above said support panel for positioning an upper one of said containers on said stackable container; and an opening defined in at least one of said panels and located beneath said extension for receiving an extension of a lower one of said containers to position said stackable container on the lower container.

2. The stackable container of claim 1, further comprising an end flap for reinforcing said side panel, said end flap being connected to said support panel by a fold line, said end flap having an outside surface which is adhesively secured to an inside surface of said side panel, said end flap having vertical corrugations.

3. The stackable container of claim 2, wherein said end flap forms a 45° angle with said support panel, said support panel forms a 45° angle with said end panel.

4. The stackable container of claim 3, wherein said support panel has a top edge for forming a ventilation space between said side panel and the upper container, a ventilation space between said end panel and the upper container, and a ventilation space between said reinforcing flap and the upper container.

5. The stackable container of claim 4, wherein said side panel and said end panel have elongated top edges, said top edge of said support panel being above said elongated edges.

6. The stackable container of claim 5, wherein said reinforcing flap has a lower edge, said opening being defined by said lower edge, said lower edge being above said bottom panel.

7. The stackable container of claim 6, further comprising a notch which is removed from said bottom panel and said side panel, said opening being defined by said notch.

8. The stackable container of claim 7, further comprising: a second support panel for supporting the upper container on said stackable container, said second support panel being connected to said end panel by a fold line, said second support panel having vertical corrugations, said second support panel being symmetrical with and opposite to said first support panel; a second side panel for forming a second side of said stackable container, said second side panel being connected to said bottom panel by a fold line, said second side panel having horizontal corrugations, said second side panel being symmetrical with and opposite to said first side panel; and a second reinforcing flap for reinforcing said end panel, said second reinforcing flap being connected to said second side panel by a fold line, said second reinforcing flap being connected to said end panel along a substantial portion of said end panel, said second reinforcing flap being symmetrical with and opposite to said first reinforcing flap.

9. The stackable container of claim 8, further comprising: a second end panel symmetrical with and opposite to said first end panel; support panels symmetrical with and opposite to said first and second support panels; and reinforcing flaps symmetrical with and opposite to said first and second reinforcing flaps.

10. The stackable container of claim 7, wherein said end panel is shorter in height than said side panel.

11. The stackable container of claim 7, further comprising a second reinforcing flap for reinforcing said end panel, said second reinforcing flap being symmetrical with and opposite to said first reinforcing flap, said second reinforcing flap being adhesively secured to said end panel along a substantial portion of said end panel, said reinforcing flaps covering at least approximately 70% of said end panel.

12. A foldable blank of corrugated material for forming a stackable container, said blank comprising:

a bottom panel forming a bottom of said stackable container; an end panel for forming an end of said stackable container, said end panel being connected to said bottom panel by a fold line; a support panel for supporting an upper container on said stackable container, said support panel being connected to said end panel by a fold line; a side panel for forming a side of said stackable container, said side panel being connected to said bottom panel by a fold line; and a reinforcing flap for reinforcing said end panel, said reinforcing flap being connected to said side panel by a fold line, said reinforcing flap being connectable to said end panel along a substantial portion of said end panel;

an extension for positioning an upper one of said containers on said stackable container; and an opening defined in at least one of said panels and located beneath said extension for receiving an extension of a lower one of said containers to position said stackable container on the lower container.

13. A stackable container formed of foldable material, comprising:

a main sheet comprising: a bottom panel forming a bottom of said stackable container; a first side panel for forming a side of said stackable container, said side panel being connected to said bottom panel by a fold line; a first support panel for supporting an upper container on said stackable container, said support panel being connected to said side panel by a fold line; and a first connection panel connected to said bottom panel by a fold line;

a reinforcing sheet separate from said main sheet, said reinforcing sheet comprising: an end panel for forming an end of said stackable container, said end panel being connected to said connection panel; a first reinforcing flap, said reinforcing flap being connected to said end panel by a fold line, said reinforcing flap being connected to said side panel along a substantial portion of said side panel;

an extension above said support panel for positioning an upper one of said containers on said stackable container; and an opening beneath said extension for receiving an extension of a lower one of said containers to position said stackable container on the lower container.

14. The stackable container of claim 13, further comprising an end flap connected to said support panel by a fold line, an outside surface of said end flap being adhesively secured to an inside surface of said end panel.

15. The stackable container of claim 14, wherein said end flap forms a 45° angle with said support panel, and said support panel forms a 45° angle with said side panel.

16. The stackable container of claim 15, wherein said support panel has a top edge for forming a ventilation space between said side panel and the upper container, a ventilation space between said end panel and the upper container, and a ventilation space between said reinforcing flap and the upper container.

17. The stackable container of claim 16, wherein said side panel and said end panel have elongated top edges, said top edge of said support panel being above said elongated edges.

18. The stackable container of claim 17, wherein: said reinforcing sheet has a portion which is cut out of said end panel and said reinforcing flap, said cut out portion having an upper edge, said opening being defined by said upper edge of said cut out portion, said upper edge being above said bottom panel.

19. The stackable container of claim 18, further comprising a notch formed in said main sheet, said opening being defined by said notch.

20. The stackable container of claim 19, further comprising: a second side panel for forming a second side of said stackable container, said second side panel being connected to said bottom panel by a fold line, said second side panel being symmetrical with and opposite to said first side panel; a second support panel for supporting the upper container on said stackable container, said second support panel being connected to said second side panel by a fold line, said second support panel being symmetrical with and opposite to said first support panel; and a second reinforcing flap connected to said end panel by a fold line, said second reinforcing flap being connected to said second side panel along a substantial portion of said second side panel, said second reinforcing flap being symmetrical with and opposite to said first reinforcing flap.

21. The stackable container of claim 19, further comprising: a second reinforcing sheet symmetrical with and opposite to said first reinforcing sheet; a connection panel symmetrical with and opposite to said first connection panel; support panels symmetrical with and opposite to said first and second support panels; and reinforcing flaps symmetrical with and opposite to said first and second reinforcing flaps.

22. The stackable container of claim 19, wherein said reinforcing sheet has vertical corrugations.

23. The stackable container of claim 19, wherein said end panel is shorter than said side panel.

24. The stackable container of claim 19, wherein said end panel is longer than said side panel.

25. The stackable container of claim 19, further comprising a second reinforcing flap, said second reinforcing flap being symmetrical with and opposite to said first reinforcing flap, said second reinforcing flap being adhesively secured to said side panel along a substantial portion of said side panel, said reinforcing flaps covering at least approximately 70% of said side panel.

26. A foldable blank for forming a stackable container, said blank comprising:

a main sheet comprising: a bottom panel forming a bottom of said stackable container; a side panel for forming a side of said stackable container, said side panel being connected to said bottom panel by a fold line; a support panel for supporting an upper container on said stackable container, said support panel being connected to said side panel by a fold line; and a connection panel, said connection panel being connected to said bottom panel by a fold line;

a reinforcing sheet separate from said main sheet, said reinforcing sheet comprising: an end panel for forming an end of said stackable container, said end panel being connectable to said connection panel; and a reinforcing flap connected to said end panel by a fold line, said reinforcing flap being connectable to said side panel along a substantial portion of said side panel;

an extension for positioning an upper one of said containers on said stackable container; and means in at least one of said panels forming an opening beneath said extension for receiving an extension of a lower one of said containers to position said stackable container on the lower container.

* * * * *

UNITED STATES PATENT AND TRADEMARK OFFICE

CERTIFICATE OF CORRECTION

PATENT NO. : 4,905,834

DATED : March 6, 1990

INVENTOR(S) : Emilio Mur Gimeno and Francisco Iborra Guijarro

It is certified that error appears in the above-identified patent and that said Letters Patent is hereby corrected as shown below:

ON THE TITLE PAGE

At item [30] Foreign Application Priority Data, add the following:

--Jun. 20, 1988 [ES] Spain.....8801976--

Signed and Sealed this

Ninth Day of June, 1992

*Attest:*

DOUGLAS B. COMER

*Attesting Officer*

*Acting Commissioner of Patents and Trademarks*